US010508003B2

(12) United States Patent
Miller et al.

(10) Patent No.: US 10,508,003 B2
(45) **Date of Patent: *Dec. 17, 2019**

(54) ELEVATOR COVER ASSEMBLY

(71) Applicant: Harry Miller Company, Inc., Boston, MA (US)

(72) Inventors: Harry Miller, Boston, MA (US); Michael Frisch, Braintree, MA (US); Ray Metcalfe, Scarborough, CA (US)

(73) Assignee: HARRY MILLER CO., LLC, Boston, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/901,640

(22) Filed: Feb. 21, 2018

(65) Prior Publication Data

US 2018/0179024 A1 Jun. 28, 2018

Related U.S. Application Data

(60) Division of application No. 15/358,108, filed on Nov. 21, 2016, now abandoned, which is a continuation-in-part of application No. 13/790,959, filed on Mar. 8, 2013, now Pat. No. 9,499,930.

(51) Int. Cl.

| | |
|---|---|
| ***B66B 11/02*** | (2006.01) |
| ***A47H 1/18*** | (2006.01) |
| ***A47H 23/02*** | (2006.01) |

(52) U.S. Cl.

CPC ..... *B66B 11/0253* (2013.01); *A47H 1/18* (2013.01); *A47H 23/02* (2013.01); *B66B 11/0226* (2013.01); *A47H 2023/025* (2013.01); *Y10T 24/51* (2015.01); *Y10T 156/1056* (2015.01); *Y10T 428/192* (2015.01)

(58) Field of Classification Search

CPC ..... B66B 11/0253
USPC ..... 428/58
See application file for complete search history.

(56) References Cited

U.S. PATENT DOCUMENTS

| | | | |
|---|---|---|---|
| 4,045,076 | A | 8/1977 | Day, Sr. et al. |
| 4,324,074 | A | 4/1982 | South et al. |
| 4,611,779 | A | 9/1986 | Leonard, Jr. |

(Continued)

OTHER PUBLICATIONS

Soft grip Adhesive Hook, Retrieved Dec. 2012, from http://www.organizedobie.com/products/3121/Soft-Grip-Adhesive-Hook.

(Continued)

*Primary Examiner* — Brent T O'Hern
(74) *Attorney, Agent, or Firm* — Lowe Graham Jones PLLC

(57) ABSTRACT

An elevator cover assembly having a cover pad and a trim with openings for receiving a hanging knob inside the elevator is disclosed. The trim is a separate piece attached to the elevator cover after openings are made in the trim. The trim slits formed therein are sized and positioned to receive hanging knobs. The trim is made of a flexible material that can be deformed to broaden the openings to more easily position the openings over the knobs. A hanging knob can be a stud device attached to any wall for hanging a wall cover. The stud device comprises a mount attached to a wall, and a knob extending from the mount and extending outwardly from the wall. The knob is configured to receive an opening of the wall cover to hang the wall cover. A variety of such stud devices is provided.

40 Claims, 19 Drawing Sheets

(56) References Cited

U.S. PATENT DOCUMENTS

| | | | | |
|---|---|---|---|---|
| 5,120,168 | A | 6/1992 | Padula | |
| 5,255,885 | A | 10/1993 | Iversen | |
| 5,660,402 | A | 8/1997 | Jones et al. | |
| 5,816,557 | A | 10/1998 | Tepper | |
| 6,471,169 | B1 | 10/2002 | Maloney | |
| 6,641,105 | B1 | 11/2003 | Hamerski | |
| 9,499,930 | B2 * | 11/2016 | Miller | A47H 1/18 |
| 2002/0168245 | A1 | 11/2002 | Kuo-Tai | |
| 2006/0038100 | A1 | 2/2006 | Grieszmer et al. | |
| 2007/0243784 | A1 * | 10/2007 | Shearrow | A47G 9/0284<br>442/320 |
| 2008/0092970 | A1 | 4/2008 | Carnevali | |
| 2009/0148254 | A1 | 6/2009 | Carrillo, Sr. et al. | |

OTHER PUBLICATIONS

Command Timeless Brushed Nickel Finish Medium Hook, Retrieved Dec. 2012, from http://www.command.com/wps/portal/3M/en_US/NACommand/Command/Products/Catalog/~/Command-Timeless-Brushed-Nickel-Finish-Medium-Hook?N=5925317&rt=rud>.

* cited by examiner

ELEVATOR COVER ASSEMBLY

PRIORITY CLAIM

This patent application is a Divisional of U.S. patent application Ser. No. 15/358,108 entitled ELEVATOR COVER ASSEMBLY filed on Nov. 21, 2016, which is a Continuation-In-Part of U.S. patent application Ser. No. 13/790,959, entitled ELEVATOR COVER ASSEMBLY, filed on Mar. 8, 2013, and issued as U.S. Pat. No. 9,499,930 on Nov. 22, 2016, all of which are hereby incorporated by reference.

TECHNICAL FIELD OF THE INVENTION

The invention relates generally to a cover assembly for hanging against a surface to protect the surface, such as in an elevator to protect the walls of the elevator.

BACKGROUND OF THE INVENTION

Elevator pads are commonly used in elevators to protect the interior surfaces from scratching or other damage. The elevator pads can be attached to the interior walls of the elevator when a large or potentially damaging cargo is to be carried by the elevator, such as when a tenant in an apartment building moves in or out. Conventionally these elevator pads are clipped to the walls of the elevator or otherwise attached by a metal hanger or by another type of hardware. The pads include holes in the pad itself arranged at certain intervals along a top edge of the pad to attach to a peg or post in the elevator. However, this arrangement has significant disadvantages. For example, the spacing of the holes may not match with the spacing of the pegs in a given elevator installation. Making additional holes or other accommodations can be a costly process and may compromise the strength of the pad. Some elevator pads have buttonholes with stitching around the interior edges, which are time-consuming and expensive to manufacture. These configurations are not easily modifiable and may not fit a given installation of pegs. Making adjustments to the pegs themselves in the elevator is even more costly and difficult. Also, placing the holes in the pad itself may weaken the pad or cause it to tear at any spacing interval. Another problem is accommodating an installation with an irregular ceiling profile. Pads are generally produced with a straight top edgea leaving the proprietor with the choice of modifying the pad somehow to accommodate the ceiling or leaving a portion of the ceiling uncovered by the pad. Neither option is ideal. There is a need in the art for a simpler, more easily deployed elevator pad.

SUMMARY OF THE INVENTION

The present disclosure is generally directed to an elevator protection assembly including a substantially flat protective cover sufficiently thick and sturdy to protect an interior surface of an elevator, and a trim formed separately from the cover and attached to an edge of the cover. The trim has a first edge attached to an upper edge of the cover and a second edge extending beyond the upper edge of the cover. The assembly also includes a plurality of openings formed in the trim and configured to receive projections such as hooks extending from within elevator to hang the cover assembly within the elevator. The second edge of the trim extends beyond the edge of the cover a sufficient distance that the openings are positioned on the trim beyond the edge of the cover.

In some embodiments, the projection (or hook) includes a base, a stem protruding from the base, and a head coupled to the outer end of the stem. The base provides a stable support for the stem and is secured to a wall with a quick-curing permanent adhesive. The head is preferably slightly larger than the stem to maintain the elevator cover assembly on the projection.

In still other embodiments, the present disclosure is directed to a method of forming an elevator cover assembly. The method includes forming an elevator cover pad from a generally flat, protective sheet of material having sufficient resiliency and durability to protect an elevator wall from a predetermined amount of impact or abrasion. Trim is attached to an edge of the cover pad. Before attachment to the cover, the trim is formed separately from the cover from a woven synthetic material and is sized and positioned to support the cover pad in a desired orientation within the elevator. The method also includes forming a plurality of openings in the trim oriented to correspond to a plurality of projections within the elevator.

The cover may have an irregular profile, including one or more cover regions having a stepped or angled profile. The method further includes attaching the trim in segments to the cover regions at lengths corresponding to the length of the cover regions.

In yet other embodiments, the present disclosure is directed to a knob for use with an elevator wall cover. The knob has a base, a projection extending from the base a sufficient distance to provide support for the elevator wall cover, and an attachment mechanism coupled to the base. The attachment mechanism is configured to secure the base to an elevator wall to be protected by the elevator pad. The knob also includes a head at the outer end of the projection configured to hold the elevator cover on the knob.

In yet other embodiments, the present disclosure is directed to stud devices for use with a wall cover for covering any wall, such as in hallways, elevators, classrooms, conference rooms, offices, bedrooms, etc., whether vertical walls, ceilings, or other areas that need to be covered for protection. A particular stud device can comprise a mount attached to a wall, and a knob extending from the mount and extending outwardly from the wall. The knob is configured to receive an opening of the wall cover to hang or otherwise retain/support the wall cover. A variety of such stud devices is provided, as further exemplified below.

BRIEF DESCRIPTION OF THE DRAWINGS

Preferred and alternative examples of the present invention are described in detail below with reference to the following drawings.

DETAILED DESCRIPTION OF THE PREFERRED EMBODIMENTS

Figure 1:
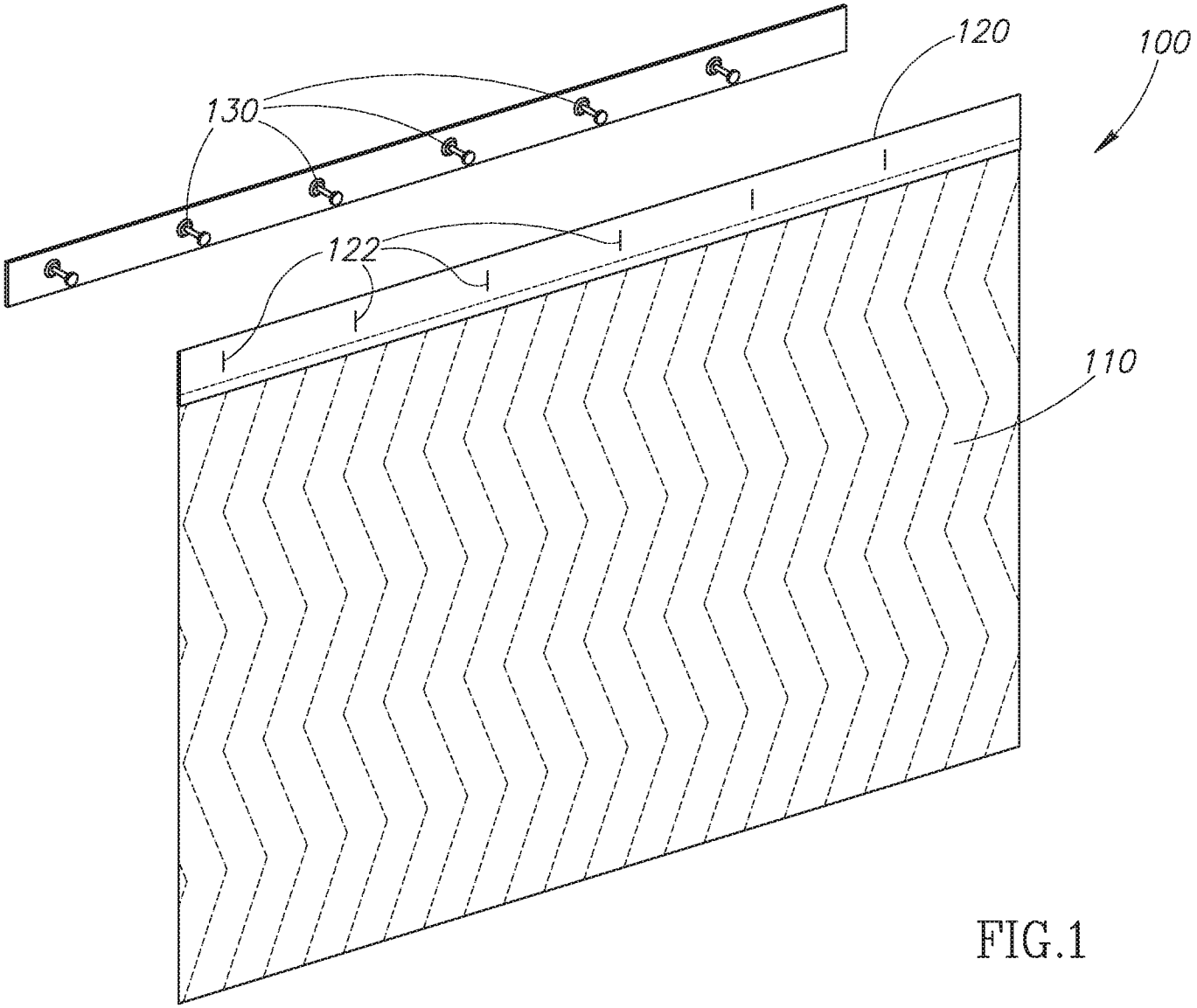
FIG. 1 is a schematic isometric depiction of a cover, trim, and knobs according to embodiments of the present disclosure.

FIG. 1 illustrates an elevator cover assembly 100 having a cover 110 and a trim 120. The cover 110 is a sheet of material with sufficient resiliency and padding to protect a surface, such as an interior surface of an elevator. The embodiments of the invention disclosed herein are specifically tailored to protect interior elevator walls. The cover 110 is preferably made of flexible fabric with padding sewn into the interior as is standard in the industry. The cover 110 can include rigid panels joined together with flexible fabric sections. The cover 110 is generally flexible enough to fit through the elevator door. The trim 120 is a strip of material positioned at an edge of the cover 110. The trim 120 is attached to the cover 110 by stitching or other suitable attachment means. The trim 120 has a plurality of openings 122 formed in the trim 120. In some embodiments, the trim 120 is made of a flexible material, such as a woven synthetic material like nylon, that is attached to the edge of the cover 110 with a portion of the trim 120 extending beyond the edge of the cover 110.

The trim 120 is formed as a separate piece from the cover 110 and is later attached to the cover 110. The trim 120 can be made in large quantities separate from the cover and can be cut to any length to fit any size of cover. The openings 122 can easily be formed in the trim 120 before the trim 120 is attached to the cover 110. In some embodiments, the openings 122 are slits formed by passing a heated blade through the trim 120 at desired intervals. The heated blade also melt-fuses the cut synthetic material ends to bond them together such that they do not fray or tear. The openings 122 can also be holes, key-hole openings (e.g. combination slit and hole), crescent shape openings, etc. In other embodiments, the trim 120 can be initially formed to include the openings, such as by including a lower scalloped or jagged edge that will engage a knob to keep the cover in place.

The apparatus and methods of production of the present invention are very economical compared to conventional methods, such as cutting and sewing buttonholes in the cover itself. In some embodiments of the present invention, the trim 120 can be passed under a wheel having appropriately shaped blades at desired intervals such that the openings 122 are formed by simply moving the trim web under the blade wheel. As mentioned above, the blades can be heated to fuse the edges of the openings in the synthetic material that forms the trim to prevent fraying or tearing. In other embodiments, the openings 122 can be formed using a radio frequency weld, which is also very cost-effective compared to conventional techniques.

The flexible nature of the trim 120 allows the trim 120 to be deformed to spread the openings 122 to insert the knob 130 into the slits. The spacing of the openings 122 is designed to correspond to the spacing of the knobs 130 for hanging. For example, the knobs 130 can be positioned in the interior of an elevator near the top of the walls. In preferred embodiments, the trim material is chosen such that it can withstand openings separated by very short intervals, such as approximately one inch between openings. Likely this spacing is more frequent than the knobs will be, but the high frequency makes the assembly able to fit a variety of knob configurations.

In some embodiments, the trim 120 is oriented generally horizontally and is positioned at a top of the cover 110. In other embodiments, the trim 120 can be positioned vertically along a side edge of the cover 110. The cover assembly 100 can have multiple trims along multiple edges of the cover 110. For example, the cover 110 can have a trim 120 at the right and left-hand side of the cover 110 to engage with knobs 130 aligned vertically at a deployment site, or the cover 110 can have a trim 120 at all four edges of the cover 110. In still further embodiments, the trim 120 is positioned at an interior position on the cover 110 to provide still further engagement points. The number, spacing, and layout of the knobs 130 can vary as needed. For example, for embodiments in which the cover assembly 100 is to be used with very heavy-duty equipment, where the cover 110 itself is relatively heavy, the trim 120 and corresponding knobs 130 can be more numerous and placed closer together. In other circumstances in which the cover 110 is relatively light, the openings 122 and corresponding knobs 130 can be spaced further apart. The size of the individual openings 122 can also vary according to expected load. Another variable that may influence the size of the openings 122 is the aesthetic placement of the knobs 130 in the elevator or other location. For example, the openings 122 and knobs 130 may be aligned linearly at approximately the same level such that the load of the cover 100 when resting on the knobs 130 is distributed evenly on the openings 122. The openings 122 and knobs 130, however, may not always be aligned in a linear array, perhaps for functional or aesthetic reasons. The pattern of the openings 122 can match the pattern of the knobs 130. With enough slits in the trim, the alignment to various knobs that may not have the exact spacing of the slits can still be accommodated.

Figure 2:
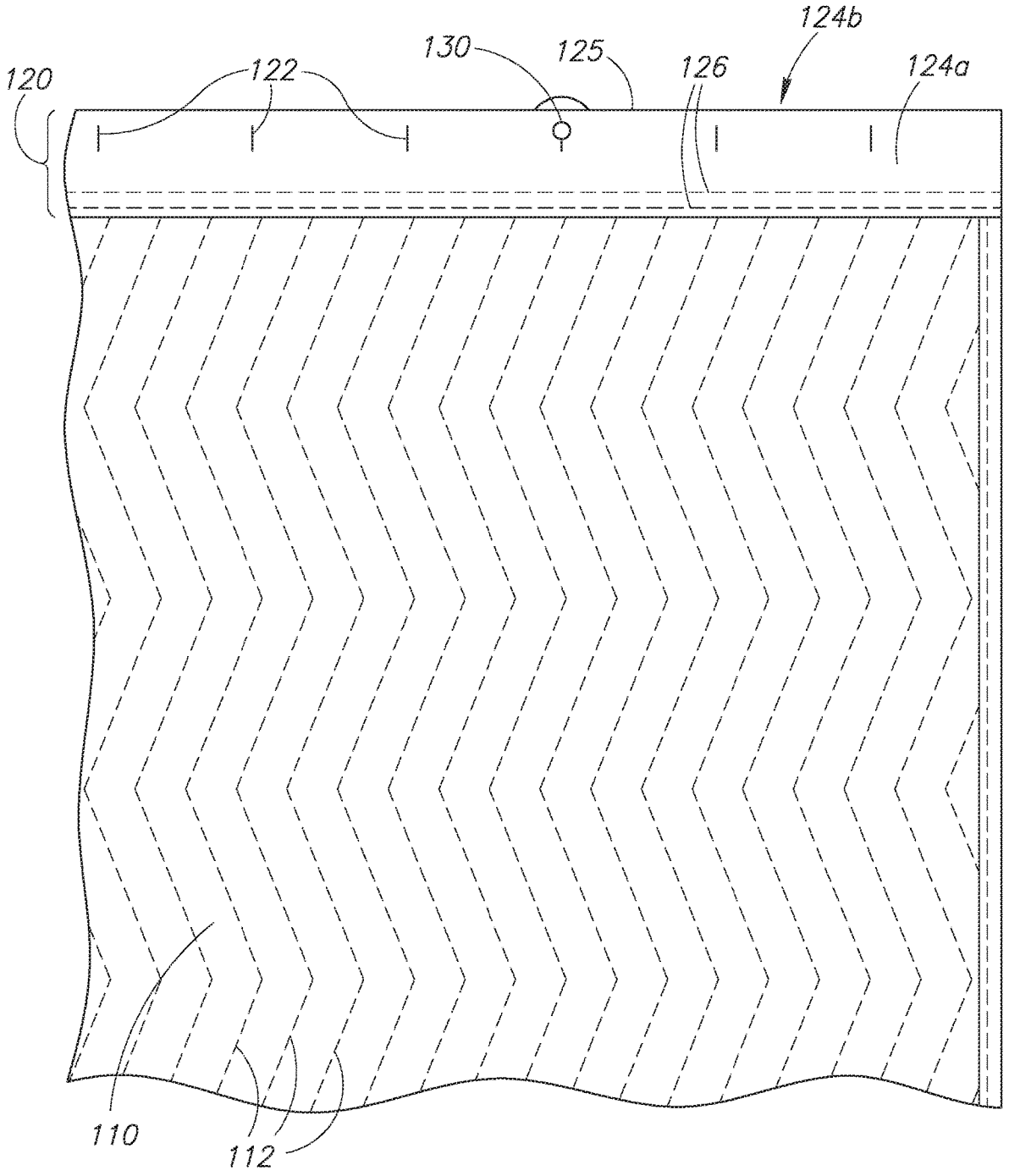
FIG. 2 is a front view of the cover assembly and a knob according to embodiments of the present disclosure.

FIG. 2 is a front view of the elevator cover assembly 100 with a single knob 130 coupled to the trim 120 according to embodiments of the present invention. The cover 110 has a herringbone stitching pattern 112 designed to improve padding capabilities. The trim 120 is a separate piece of material from the cover 110 that is then stitched to the cover 110 with two linear stitches 126. The trim 120 has a first side 124*a*, an upper edge 125 of the trim 120, and a second side 124*b* (on reverse side of trim 120; not visible in FIG. 2) opposite the first side 124*a*. The trim 120 includes multiple openings 122 spaced throughout the trim 120. The openings 122 can be made using a heated blade that melts the edges of the openings 122 to prevent fraying. Alternatively, the slits can be cut or otherwise formed in the trim 120 and then heated later to seal the edges against fraying. Since the trim 120 is a separate piece of material it can be made of a different material than the cover 110, which may not withstand so many slits at such small intervals without expensive reinforcement and or expensive cuts to make the openings. A conventional elevator pad is designed to withstand impacts, but not necessarily to support its own weight when perforated by several slits at small intervals. This drawback is avoided by the assembly 100 of the present disclosure.

A knob 130 is shown protruding through one of the openings 122. The trim 120 may have more openings 122 than the expected number of knobs 130 to provide compatibility with a number of different knob layouts. The material of the trim 120 and the cover 110 can be such that having extra openings 122 does not substantially weaken the cover assembly 100 and reduces the cost of manufacture by obviating the need to match certain slit configurations with various knob configurations. A building proprietor or service contractor, therefore, need not know the exact layout of the knobs in the elevator and potentially select a cover that does not fit the knobs. The high number and small interval of the slits provides a one-size-fits-all approach that reduces costs of manufacture and ownership.

Figure 3:
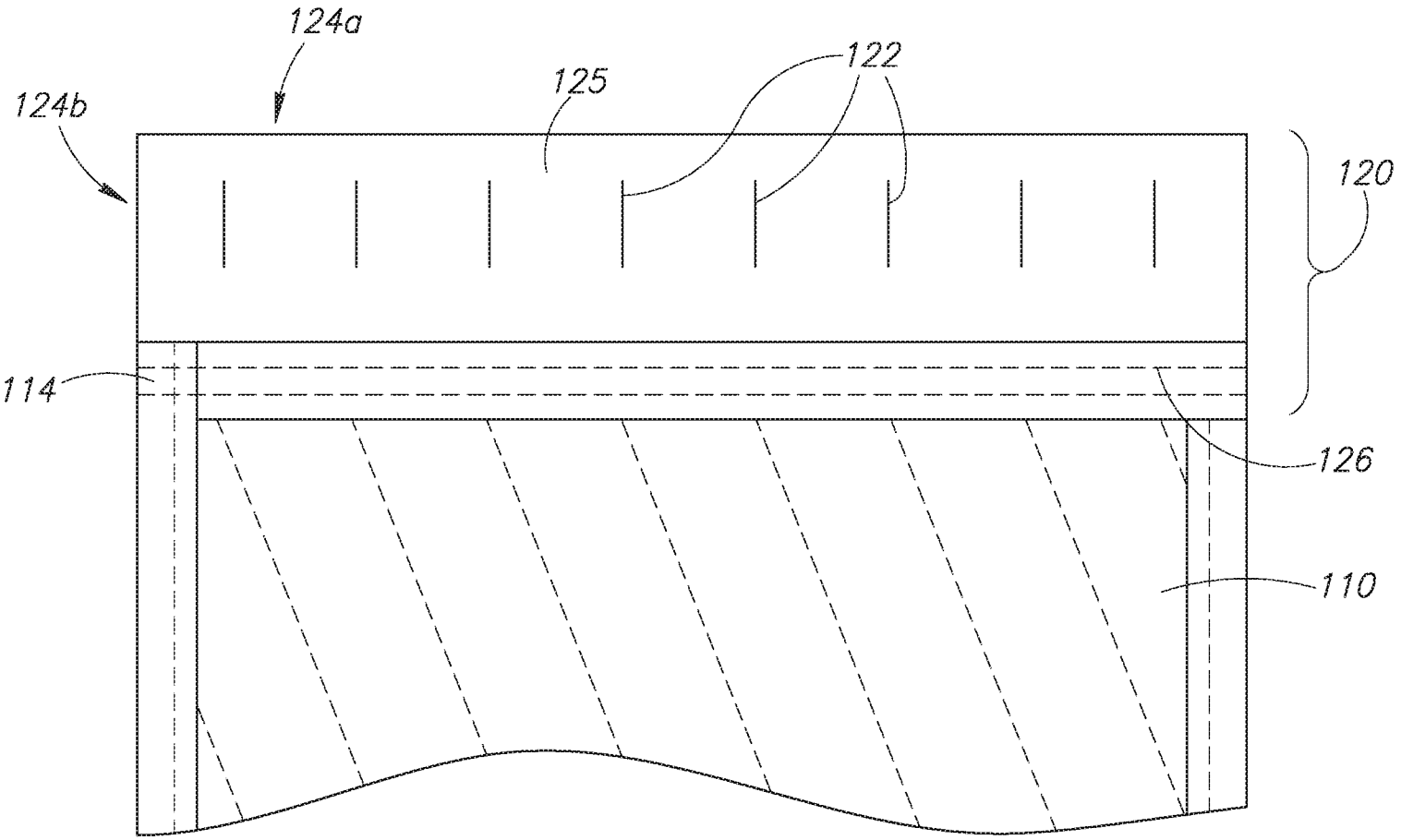
FIG. 3 is a rear view of the cover assembly of FIG. 2 according to embodiments of the present disclosure.

FIG. 3 is a rear view of the assembly 100 of FIG. 2 according to embodiments of the present disclosure. From this vantage point, the upper edge 114 of the cover 110 is visible. The openings 122 in this embodiment does not pass through any portion of the cover 110; rather, they are confined to the material of the trim 120.

Figure 4:
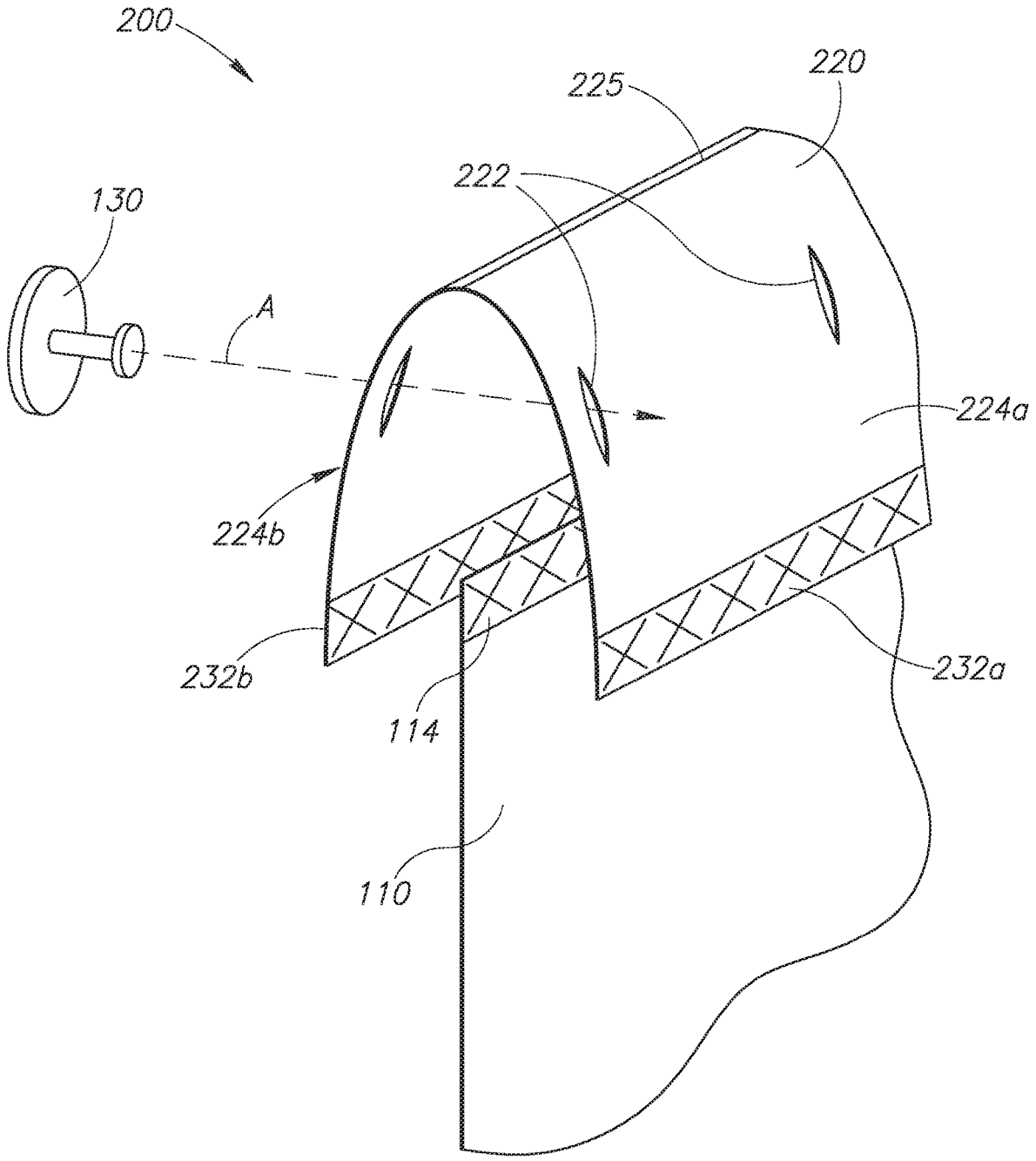
FIG. 4 is a schematic, isometric, exploded view of the elevator cover assembly according to another embodiment of the present disclosure.

FIG. 4 is a schematic, isometric, exploded view of an alternate embodiment of an elevator cover assembly 200. The assembly 200 includes a cover 100 having an edge 114 similar to previous embodiments. The edge 114 can be the top, bottom, or side edge of the cover 110. The assembly includes a trim 220 having a first side 224*a*, a second side 224*b*, and a fold 225 between the two sides. The first side 224*a* has a first trim edge 232*a*, and the second side has a second trim edge 232*b*. The first trim edge 232*a*, cover edge 114, and second trim edge 232*b* are stitched together to join the trim 220 to the cover 110. The trim 220, therefore, extends beyond the cover edge 114 by a certain distance. The assembly also includes slits 222 formed in this portion of the trim 220 for coupling with a knob 130 via the slits 222 as shown by arrow A. The slits 222 can pass through one side of the folded trim 220 or through both sides of the folded trim 220 as shown in FIG. 4. In some embodiments, the slits do not pass through the cover 110. The amount of trim 220 protruding beyond the cover edge 114 depends on the size and layout of the slits 222. In other embodiments, the cover edge 114 can extend all the way to the fold 225, and the slits 222 can be formed in the trim 220 as well as through the cover 110. In still further embodiments, the trim 220 can be a single sheet of material stitched to the cover 110 on one side, having no fold, and having slits 222 that engage the knobs 130. The trim 220 can be a long, continuous strip of material as shown in FIGS. 1-3, or it can be smaller, discrete fabric sections having slits 222 configured to engage knobs 130 to hold the cover assembly 200 in place. In still further embodiments, the slits 222 can be formed directly into the cover 110 and the trim 220 can be omitted partially or entirely.

In one example, the first and second trim edges 232*a* and 232*b* are attached to an upper portion or area of the cover 110 such that the upper edge 114 extends upwardly toward the fold 225 and beyond the trim edges. Thus, the upper edge 114 does not necessary need to be attached to the trim edges 232*a* and 232*b*. Rather, the upper edge 114 could extend up to the fold 225, whether inside or outside of the enclosure formed by trim 200. In other examples, the openings can be formed through the upper portion or area of the cover.

Figure 5:
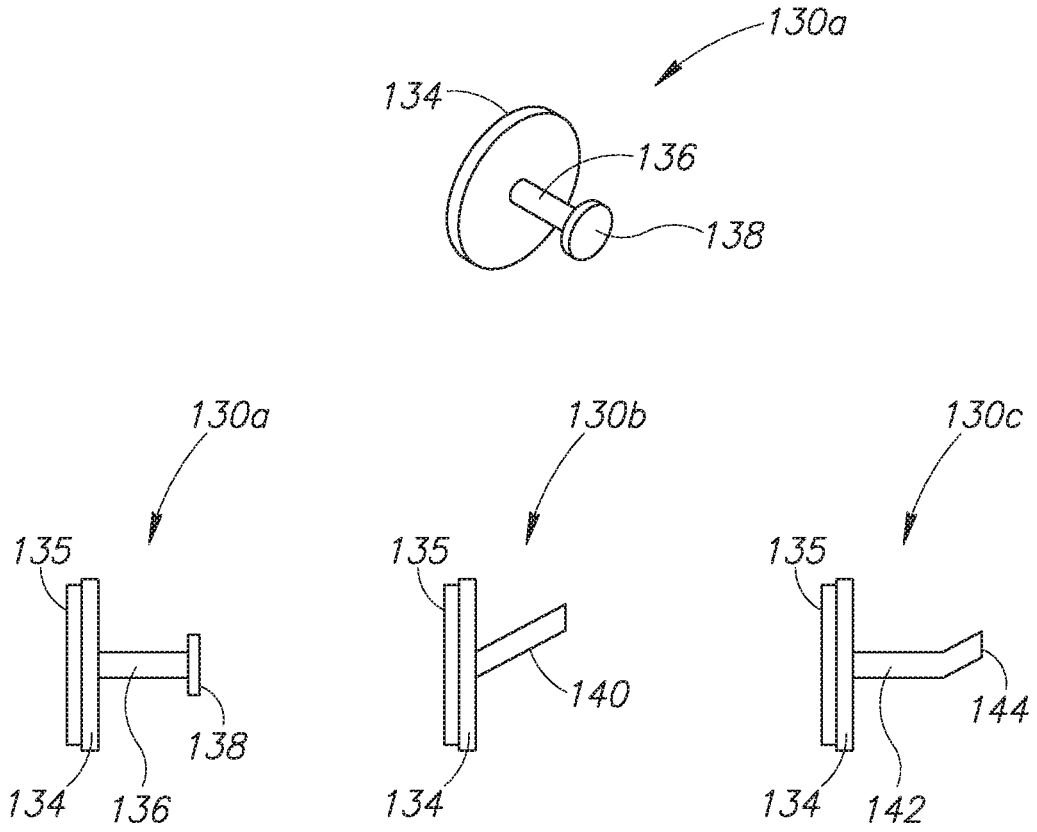
FIG. 5 illustrates various knob configurations according to the present disclosure.

FIG. 5 shows several knob configurations for use with the elevator cover assemblies disclosed herein. The knob 130*a* has a base 134, a stem 136, and a head 138 at an end of the stem 136. The head 138 can be slightly larger than the stem 136 to prevent the cover assembly 100 from falling off the knob 130. Base 134 preferably includes a quick-cure adhesive 135 on the backside thereof for easy application to a wall, including glass. The adhesive can be a high-strength adhesive such as a 3M's VHB 4941 acrylic adhesive tape that provides excellent adhesion to a broad range of high and medium surface energy substrates including metals, glass, and a wide variety of plastics and plasticized vinyl, even with mismatched substrates. The preferred adhesive tapes have very high tensile strength having a normal tensile strength of between 480-620 kPa, a 90° peel adhesion strength of between 245-385 N/100 mm, and a dynamic overlap sheer strength of between 450-620 kPa. Use of an adhesive allows the knob to be attached to the wall without intrusive and expensive penetration of the wall such as by drilling or puncturing. In other embodiments, the base 134 includes another attachment mechanism, such as a threaded fastener or the like. Other than the adhesive layer, the knob 130*a* can be a unitary piece of material or can be a base 134 welded to a stem 136 and a head 138 welded to the stem 136. It may be formed by machining or otherwise forming from a single piece of material, preferably metal.

Another embodiment is knob 130*b*, which has a base 134 and an upwardly angled stem 140. The upward slope keeps the cover assembly 100 from slipping off the knob 130*b* and therefore obviates the need for a head. The slope and length of the knob 130*b* can vary as needed for a particular installation. Another embodiment is knob 130*c*, which includes a base 134, a horizontally extending stem portion 142, and an upwardly extending portion 144 that functions similarly to the head 138 to prevent the cover assembly 100 from slipping off the knob 130*c*. In any of these embodiments, the base 134 can be omitted in favor of a simple stem and head combination extending from the wall of the elevator. In some embodiments, the knob can include a base having multiple projections extending therefrom. Virtually any configuration of the knob can be used with the elevator cover assembly of the present disclosure.

Figure 6:
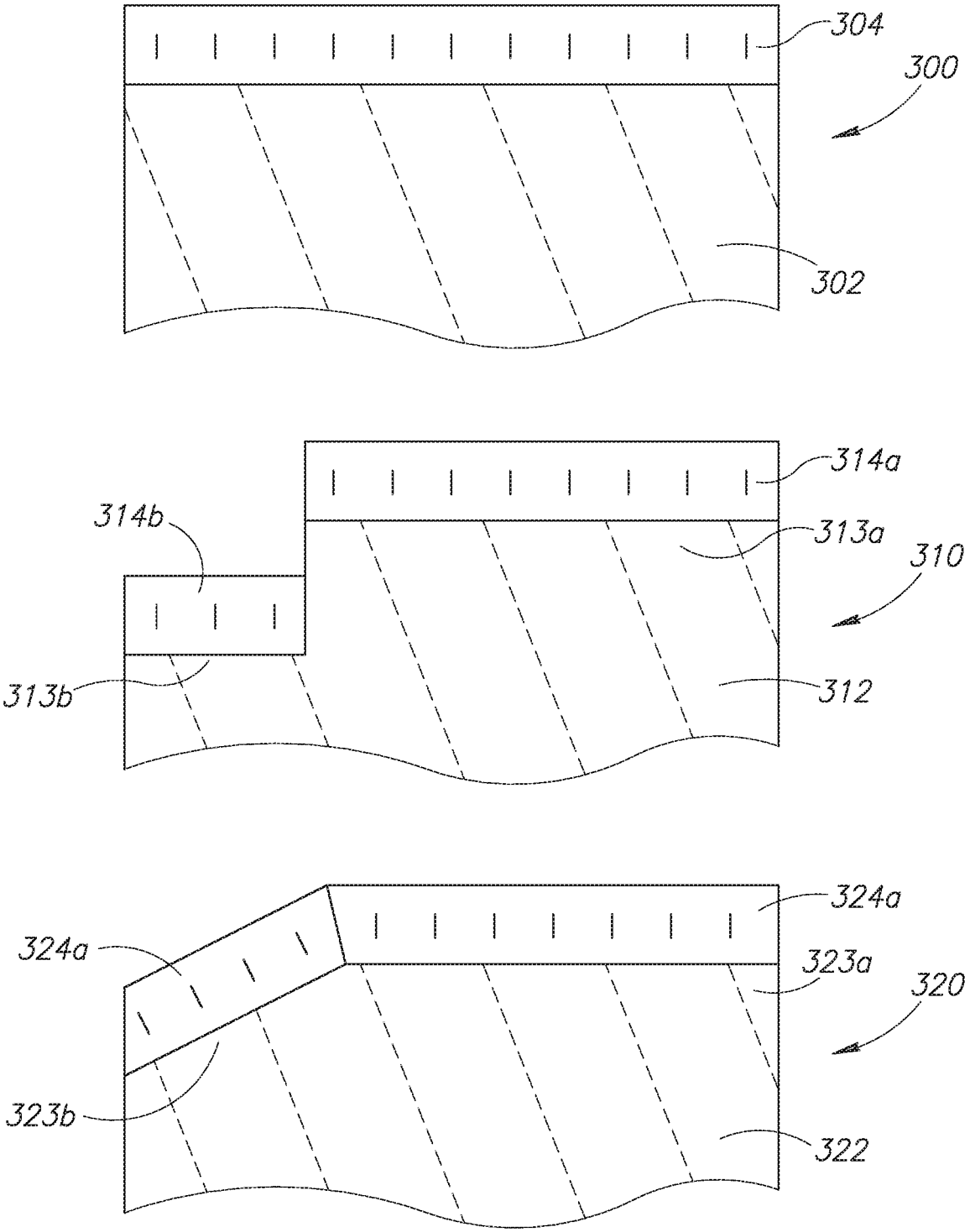
FIG. 6 illustrates cover assemblies according to embodiments of the present disclosure including a flat, stepped, and angled profile.

FIG. 6 shows three cover pad assemblies according to embodiments of the present disclosure. The first assembly 300 includes a flat cover 302 and a linear trim 304. This type of assembly will fit most elevator installations with flat ceilings without complex light fixtures that impede the cover in some way. The cover 302 can include cut-outs to accommodate emergency lights or other ceiling structures. As described above, the cover 302 and trim 304 are separate and are joined by stitching, welding, fusing, or another suitable material joining technique.

The second assembly 310 includes a cover 312 having a stepped top. A first portion 313*a* is longer than a second portion 313*b*. The assembly 310 includes a two-part trim with a first trim portion 314*a* and a second trim portion 314*b* attached to the first portion 313*a* and second portion 313*b*, respectively. The cover can have any number of different regions at different elevations to accommodate virtually any ceiling profile. The trim portions 314*a*, 314*b* can be separate strips each attached to the corresponding region of the cover independently. Constructing the separate trim strips is a simple matter of cutting the strip material to match the width of the portion to which it corresponds. Attaching the separate trim portions to the cover is also a simple matter, requiring only that the trim be sewn to the right cover region. This construction is much simpler and less expensive to manufacture than other designs in which the attachment slits are constructed directly into the cover itself with no separate material for the trim.

The third assembly 320 includes a cover 322 having a first region 323*a* that is flat and a second region 323*b* that is angled. The trim includes corresponding regions 324*a* and 324*b*. The angle of the second region 323*b* and trim portion 324*b* can take any appropriate angle as needed for a given elevator assembly. Other profile shapes are also possible, including curved and jagged profiles. By virtue of the trim being a separate material from the cover, the trim assemblies shown in FIG. 6 are much more easily constructed, yet are more durable than conventional cover assemblies.

FIGS. 7-16 show a variety of stud devices attachable to a wall for use with a wall cover, such as to cover any wall or area adjacent the wall cover. Generally, as will be further discussed in the examples below, a particular stud device can comprise a mount attachable to a wall, and a knob extending from the mount and extendable outwardly from the wall. The knob can be configured to receive an opening of a wall cover to hang the wall cover, such as the wall covers and elevator wall covers described with reference to FIGS. 1-6.

Figure 7:
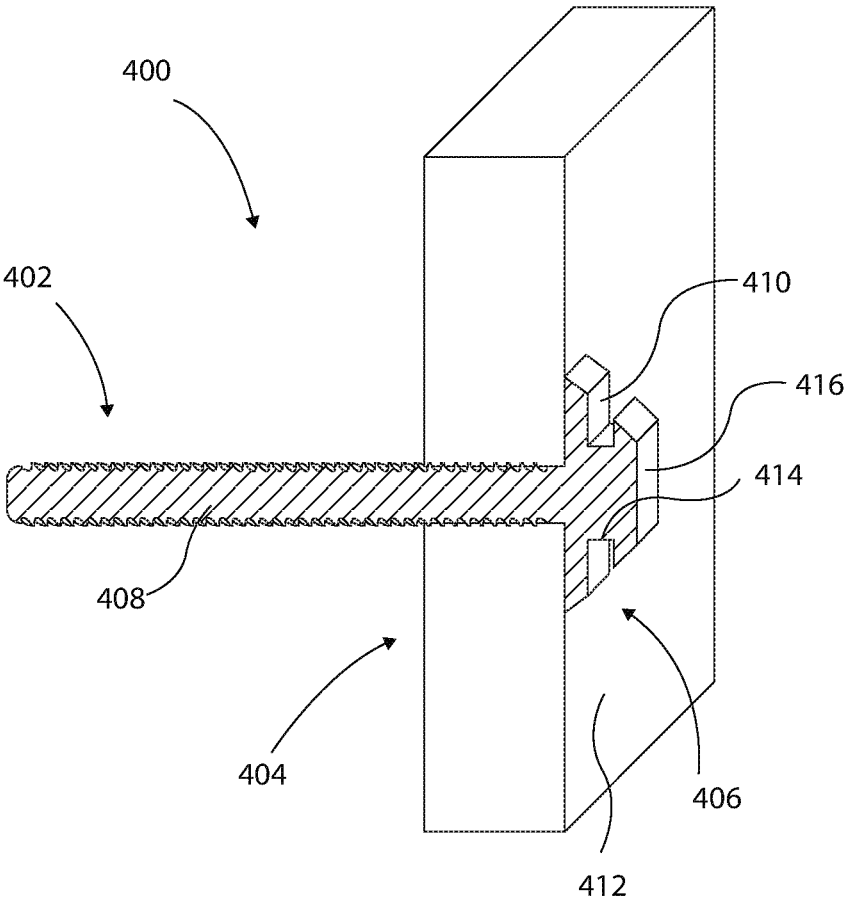
FIG. 7 is an isometric cross-sectional view of a stud device attached to a wall according to embodiments of the present disclosure.
Figure 8:
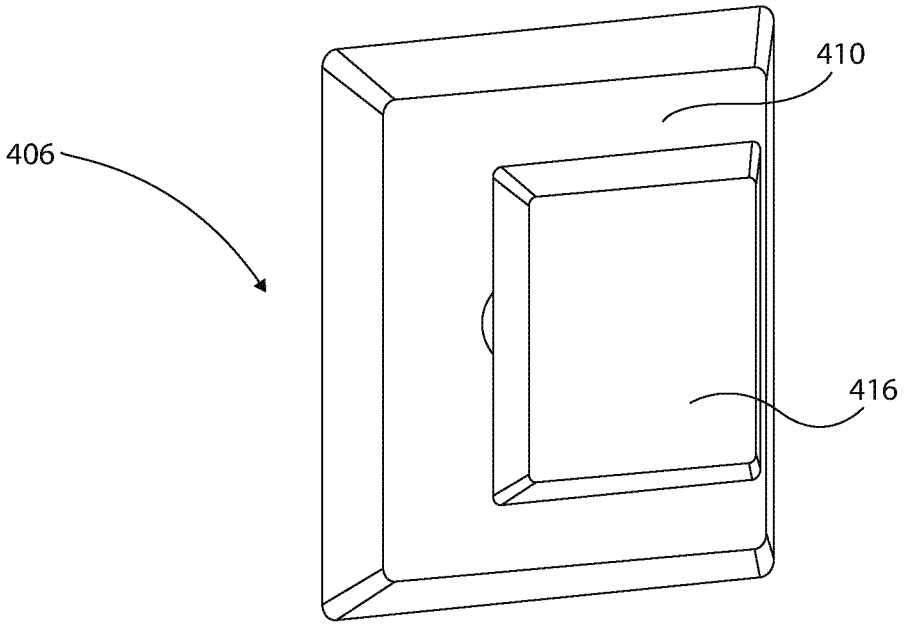
FIG. 8 is an isometric view of a portion of the stud device of FIG. 7 according to embodiments of the present disclosure.
Figure 9:
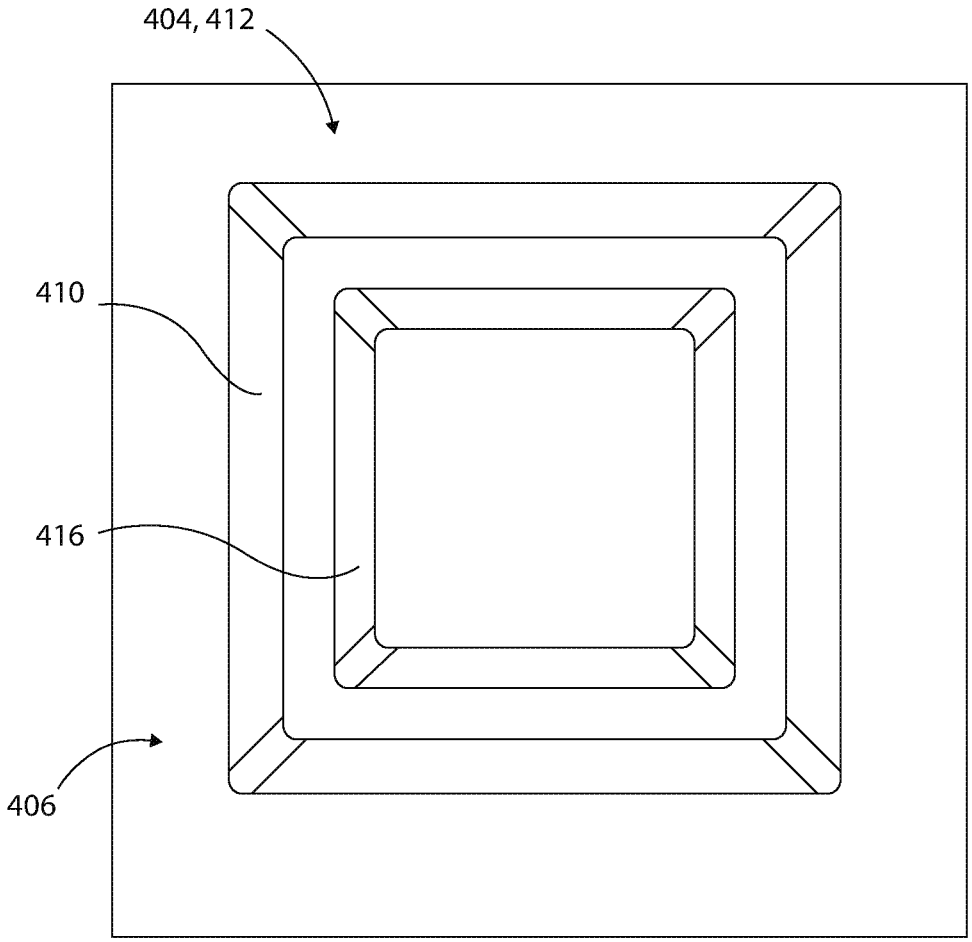
FIG. 9 is a front view of the stud device of FIG. 7 according to embodiments of the present disclosure.

In one example shown on FIGS. 7-9, a stud device 400 comprises a mount 402 attached to a wall 404. A knob 406 extends from the mount 402 and extends outwardly from the wall 404. As such, the knob 406 is configured to receive an opening (e.g., 122 of FIG. 1) of a wall cover (e.g., 110 of FIG. 1). More specifically, the mount 402 includes a shaft 408 attached to (and through) a hole in the wall 404. A mount plate 410 extends outwardly from the shaft 408 and, in one example, is configured to be flush against a surface 412 of the wall 404 about an inside planar surface of the mount plate 410. A stem 414 extends from the mount plate 410 and outwardly from the wall 404. A head 416 extends outwardly from the stem 414. Thus, the head 416 is configured (e.g., sized and shaped) to receive an opening of a wall cover to hang the wall cover from the stud device 400 to protect the wall 404.

In one aspect, the shaft 408 is a threaded fastener that can be threadably secured to the wall 404 by rotating the threaded fastener (i.e., the entire stud device) into the wall 404 until the mount plate 410 is flush against the surface 412 of the wall 404. In another aspect, the shaft 408 can receive a threaded nut on the other side of the wall, and the nut can be fastened to "pinch" the stud device 400 to the wall 404. This can help to reduce damage to the wall from threads tearing up the wall.

In one example, the head 416 has a cross-sectional area having a shape being one of a square, a rectangle, an oval, a circle, and a polygon. FIGS. 7-9 show a square shaped head 416 having a cross-sectional area sized smaller than a cross-sectional area of the mount plate 410. In a preferred example, a perimeter edge (e.g., an entire perimeter) of the head 416 is formed at an angle relative to a central axis of the shaft 408 (e.g., an "angle" between 20 and 70 degrees). Similarly, a perimeter edge of the mount plate 410 can be formed at a similar angle relative to the central axis of the shaft 408 as that of the angled edges of the head 416. Edge portions adjacent said perimeter edges (of 416 and 410) can also be chamfered (e.g., rounded, smoothed, angled, etc.) to minimize damage to objects impacting the stud device 400. As can be appreciated from FIG. 7, a distance between the mount plate 410 and the head 416 is minimized, meaning that the stem 414 is just wide enough to vertically support a relatively thin panel of fabric (e.g., trim of a wall cover). This "short" stem, along with the angled and chamfered edges of the head 416 and the mount plate 410, collectively provide a low-profile protrusion (stud device) extending from the wall 404 and that has minimal "sharp" edges or surfaces. This can minimize damage to the stud mount and to the impacting objects (or people) because the impacting object will tend to "slide along" the smoothed/angled surfaces of the stud device, which reduces the chance of something getting snagged or damaged when contacting the stud device accidentally. The low-profile design of the stud device is also non-intrusive and aesthetically pleasing. Said "angled edges" can alternatively take the form of the radial edges of FIGS. 18-20.

Figure 10:
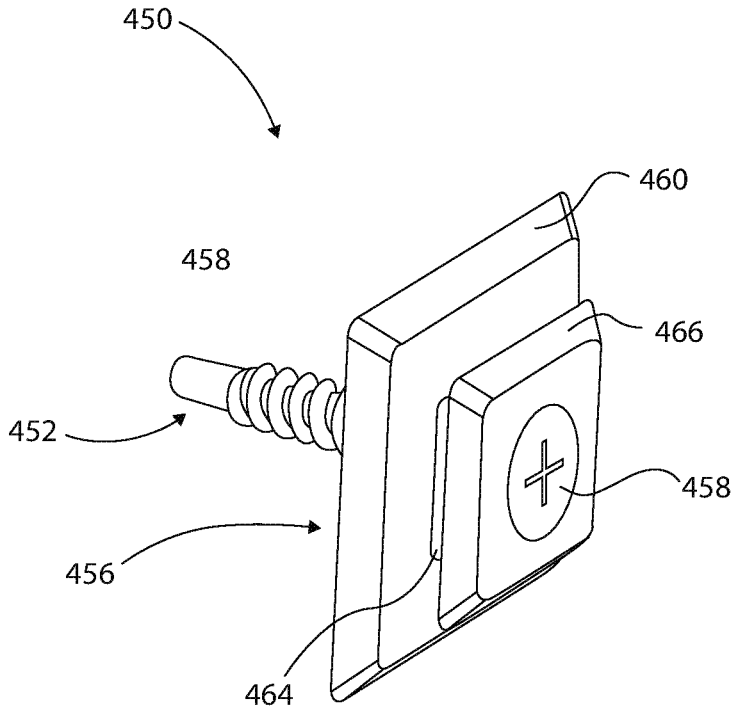
FIG. 10 is an isometric view of a stud device according to embodiments of the present disclosure.
Figure 11:
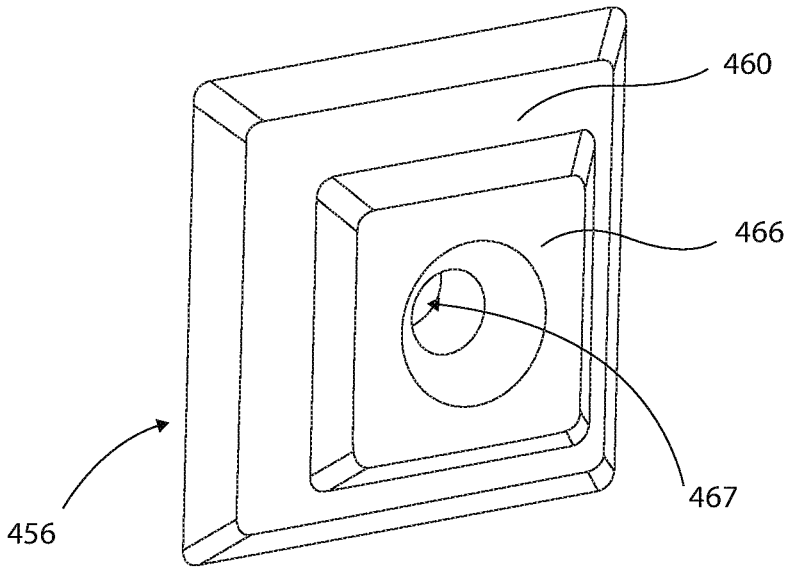
FIG. 11 is an isometric view of a portion of the stud device of FIG. 10 according to embodiments of the present disclosure.

In one example shown in FIGS. 10 and 11, a stud device 450 comprises a mount 452 attached to a wall (e.g., like the wall 404 of FIG. 7). A knob 456 extends from the mount 452 and extends outwardly from the wall. As such, the knob 456 is configured to receive an opening (e.g., 122 of FIG. 1) of a wall cover (e.g., 110 of FIG. 1). More specifically, the mount 454 comprises a threaded fastener 458 attached to (and through) a hole in the wall. The knob 456 can comprise a mount plate 460 that, in one example, is configured to be flush against a surface of the wall (similar to the mount plate of FIG. 7). A stem 464 extends from the mount plate 460 and outwardly from the wall. A head 466 extends outwardly from the stem 464. Thus, the head 466 is configured (e.g., sized and shaped) to receive an opening of a wall cover to hang the wall cover from the stud device 450 to protect the wall.

The knob 456 includes a hole 467 formed axially through the knob 456 (FIG. 11). The hole 467 can be a countersink hole that receives the threaded fastener 458 for securing to a wall. As shown in FIG. 10, the threaded fastener 458 is flush with an outer surface of the head 466, which provides a low-profile knob that minimizes damage to objects accidentally impacting the knob. Thus, the knob 456 can first be positioned to a desired position against a wall and then the threaded fastener 458 can be received through the hole 467 and then threadably secured to the wall by rotating the threaded fastener 458 into the wall until the mount plate 460 is flush and secured to the surface of the wall. In another aspect, the threaded fastener 458 can be a bolt that receives a nut on the other side of the wall, and the bolt can be fastened to "pinch" the knob to the wall.

In one aspect, the head 466 has a cross-sectional area having a shape being one of a square, a rectangle, an oval, a circle, and a polygon. FIGS. 10 and 11 show a square shaped head 466 having a cross-sectional area sized smaller than a cross-sectional area of the mount plate 460. In a preferred example, a perimeter edge (e.g., an entire perimeter) of the head 466 is formed at an angle relative to a central axis of the shaft 468 (e.g., an "angle" between 20 and 70 degrees). Similarly, a perimeter edge of the mount plate 460 can be formed at a similar angle relative to the central axis of the shaft 468 as that of the angled edges of the head 466. Edge portions adjacent said perimeter edges (of 466 and 460) can also be chamfered (e.g., rounded, smoothed, angled, etc.) to minimize damage to objects impacting the stud device 450. As can be appreciated from FIG. 10, a distance between the mount plate 460 and the head 466 is minimized, meaning that the stem 464 is just wide enough to vertically support a relatively thin panel of fabric (e.g., trim of a wall cover). This "short" stem, along with the angled and chamfered edges of the head 466 and the mount plate 460, collectively provide a low-profile protrusion (stud device) extending from the wall and that has minimal "sharp" edges or surfaces. This can minimize damage to the stud mount and to the impacting objects (or people) because the impacting object will tend to "slide along" the smoothed/angled surfaces of the stud device, which reduces the chance of something getting snagged or damaged when contacting the stud device accidentally. Said "angled edges" can alternatively take the form of the radial edges of FIGS. 18-20.

Figure 12:
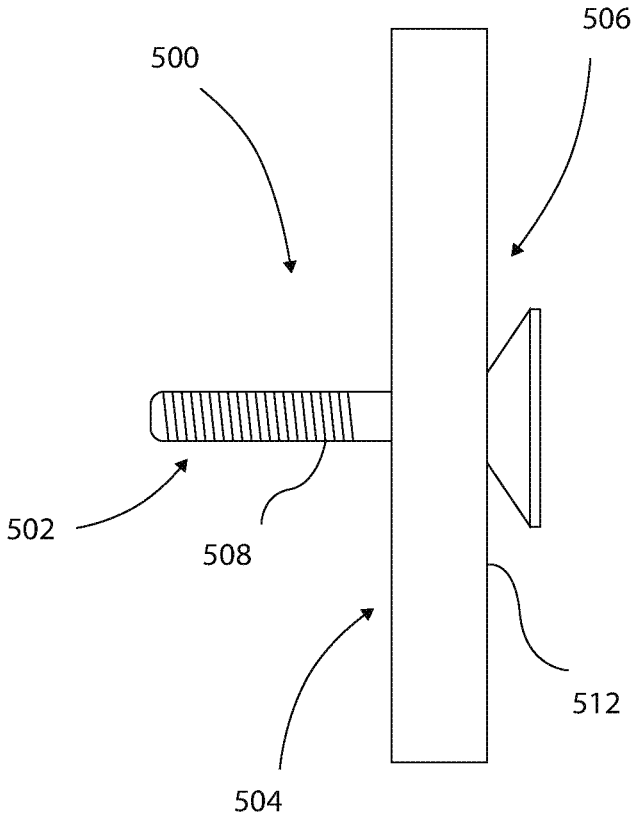
FIG. 12 is a side view of a stud device attached to a wall according to embodiments of the present disclosure.
Figure 13:
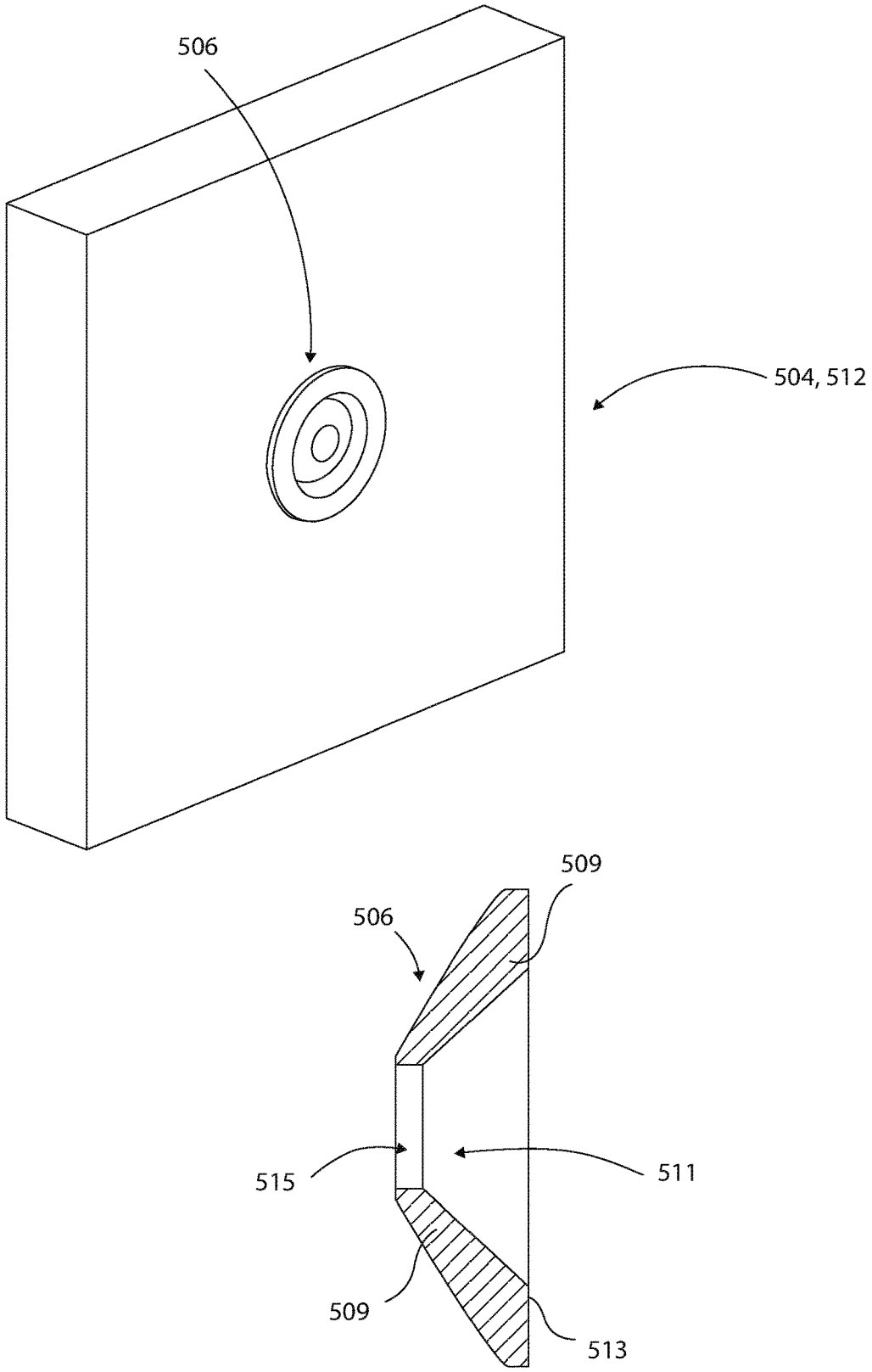
FIG. 13 is an isometric view of the stud device of FIG. 12 and a cross-sectional view of a head of the stud device of FIG. 12 according to embodiments of the present disclosure.

In one example shown in FIGS. 12 and 13, a stud device 500 comprises a mount 502 attached to a wall 504. A knob 506 extends from the mount 502 and extends outwardly from a surface 512 of the wall 504. As such, the knob 506 is configured to receive an opening (e.g., 122 of FIG. 1) of a wall cover (e.g., 110 of FIG. 1). More specifically, the mount 502 includes a shaft 508 attached to (and through) a hole in the wall 504. The shaft 508 can be a threaded bolt having a smooth/uniform surface near the knob 506 and through the hole in the wall. The knob 506 extends outwardly from the shaft 508 and, in one example, the knob 506 has a conically shaped body extending outwardly from the mount 502 and from the wall 504. Such "conically shaped body" allows a wall cover to smoothly slide along the upper portion of the conical body when an individual disposes an opening of a wall cover over the knob 506. And, the outward conical body further vertically supports a wall cover member at the upper portion of the knob 506.

As illustrated in FIG. 13, the knob 506 can include a circular side wall 509 that defines a cavity 511 that permits passage of a tool into the cavity 511 to attach the stud device 500 to and from the wall. Accordingly, a left wall of the cross-sectional view of the knob 506 can have an aperture 515 that receives a fastener to secure the knob 506 to a bore in the mount 502 (in one example). Alternatively, the cavity 511 can receive a tool for fastening the stud device 500 to the wall (i.e., the stud device would have a tool-receiving portion, such as a Philips head receiver). In any event, the stud device 500 does not have fastener protrusions extending therefrom; only the knob 506 extends from the wall 504. Moreover, the knob 506 has an outer planar surface 513 that is substantially parallel to surface 512 of the wall 504.

Figure 14:
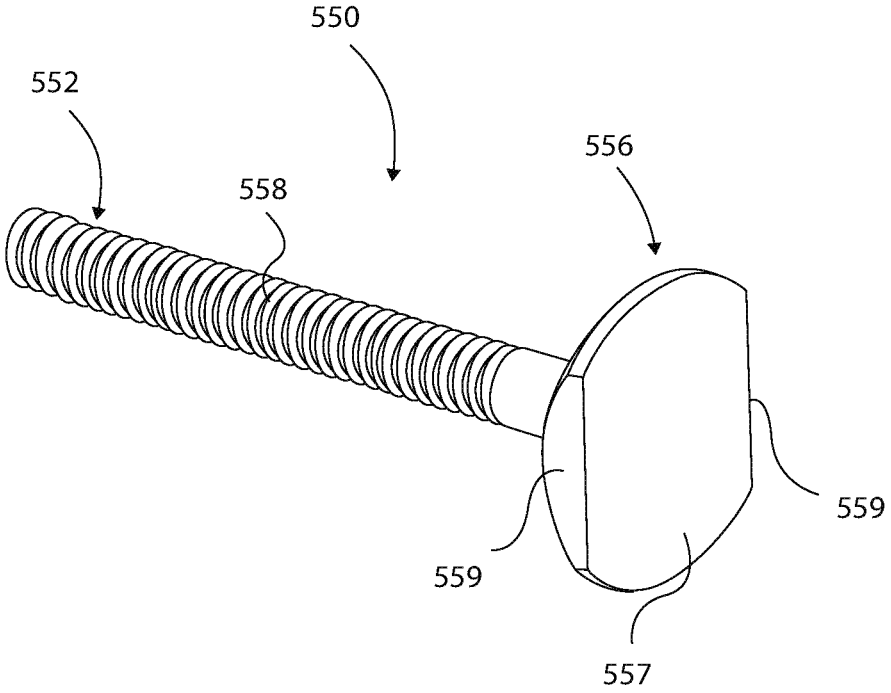
FIG. 14 is an isometric view of a stud device according to embodiments of the present disclosure.

In one example shown in FIG. 14, a stud device 550 comprises a mount 552 attached to a wall (similar to FIG. 12). A knob 556 extends from the mount 552 and extends outwardly from the wall. As such, the knob 556 is configured to receive an opening (e.g., 122 of FIG. 1) of a wall cover (e.g., 110 of FIG. 1). More specifically, the mount 552 includes a threaded shaft 558 attached to (and through) a hole in a wall. The shaft 558 can be a threaded bolt having a smooth surface near the knob 556 and through the hole in the wall. The knob 556 extends outwardly from the shaft 558 and, in one example, the knob 556 has a conically shaped body extending outwardly from the mount 552 and from the wall. Such conically shaped body allows a wall cover to smoothly slide along the upper portion of the conical body when an individual disposes an opening of the cover over the knob 556. And, the outward conical body further vertically supports a wall cover member at the upper portion of the knob 556.

In one aspect, the knob 556 includes a solid conically shaped body that terminates at a planar surface 557 that is parallel to the wall when installed. The knob 556 can also have a pair of interfacing surfaces 559 formed perpendicular to the planar surface and formed on opposing sides of the knob 556. These interfacing surfaces 559 provide surfaces for a tool (crescent wrench, or even a hand) to interface and rotatably attach the stud device 550 to and from the wall via the mount 552.

Figure 15:
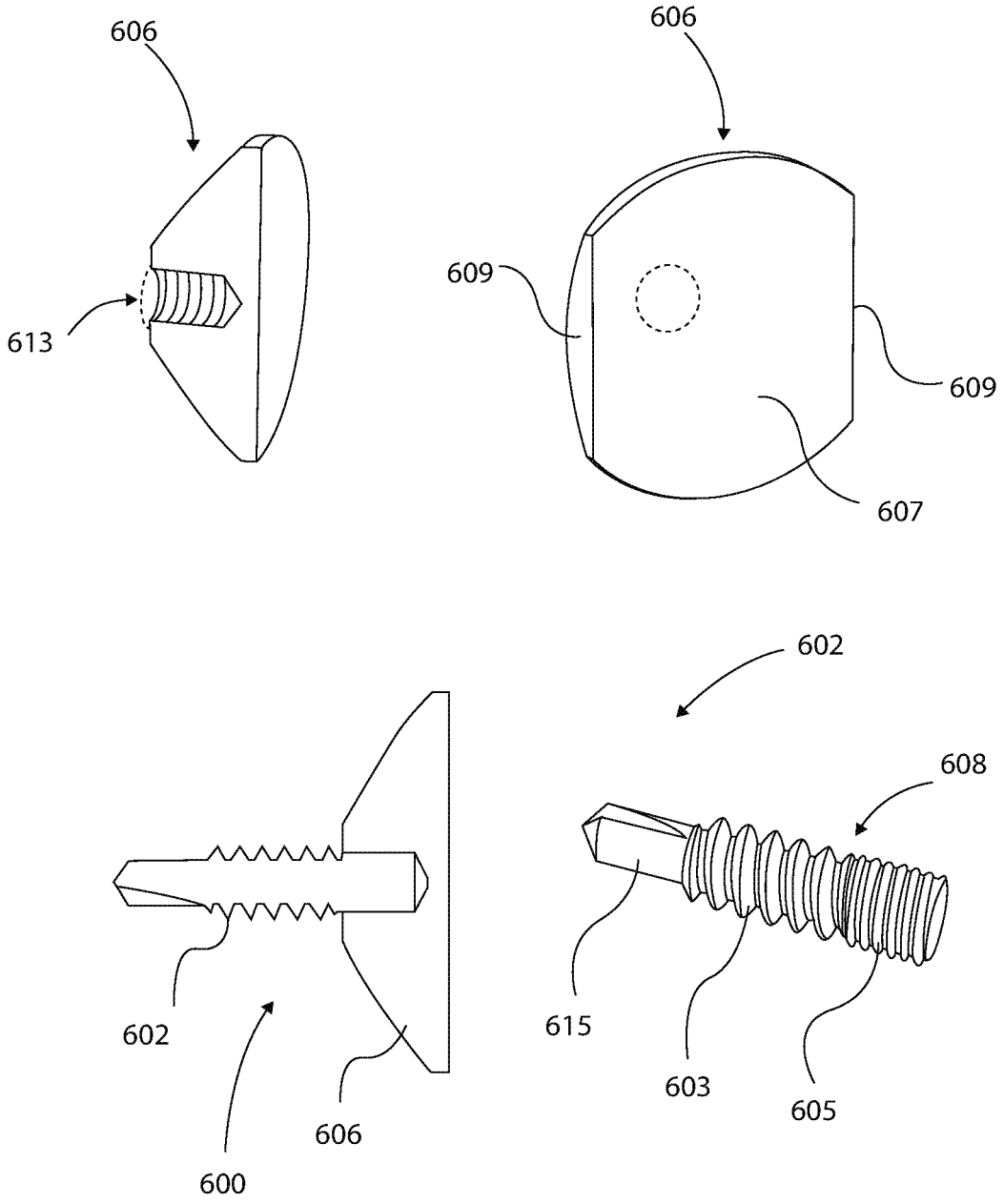
FIG. 15 shows various views of a stud device according to embodiments of the present disclosure.

In one example shown in FIG. 15, a stud device 600 comprises a mount 602 attached to a wall (similar to FIG. 12). A knob 606 extends from the mount 602 and extends outwardly from the wall. As such, the knob 606 is configured to receive an opening (e.g., 122 of FIG. 1) of a wall cover (e.g., 110 of FIG. 1). More specifically, the mount 602 comprises a threaded shaft 608 attached to (and through) a hole in the wall. The threaded shaft 608 includes a first threaded portion 603 attachable through a hold in a wall, and a second threaded portion 605 attached to the knob 606. As such, the knob 606 has a threaded bore 613 for receiving the second threaded portion 605 of the threaded shaft 608 so that the knob 606 can be removably threaded to the mount 602 as desired. Thus, the mount 602 (i.e., threaded shaft 608) can remain in the wall for a certain time, or even indefinitely, while the knob 606 is removably attached when desired. The threaded shaft can have a locking portion 615 at one end for locking the shaft to the wall.

In one aspect, the knob 606 has a conically shaped body extending outwardly from the mount and the wall. Such conically shaped body allows a wall cover to smoothly slide along the upper portion of the conical body when an individual disposes an opening of the cover over the knob 606. And, the outward conical body further vertically supports a wall cover member at the upper portion of the knob 606. In one aspect, the knob 606 includes a solid conically shaped body that terminated at a planar surface 607 that is parallel to the wall when installed. The knob 606 can also have a pair of interfacing surfaces 609 formed perpendicular to the planar surface and formed on opposing sides of the knob 606. These interfacing surfaces 609 provide surfaces for a tool to interface and rotatably attach the knob 606 to and from the mount 602.

Figure 16:
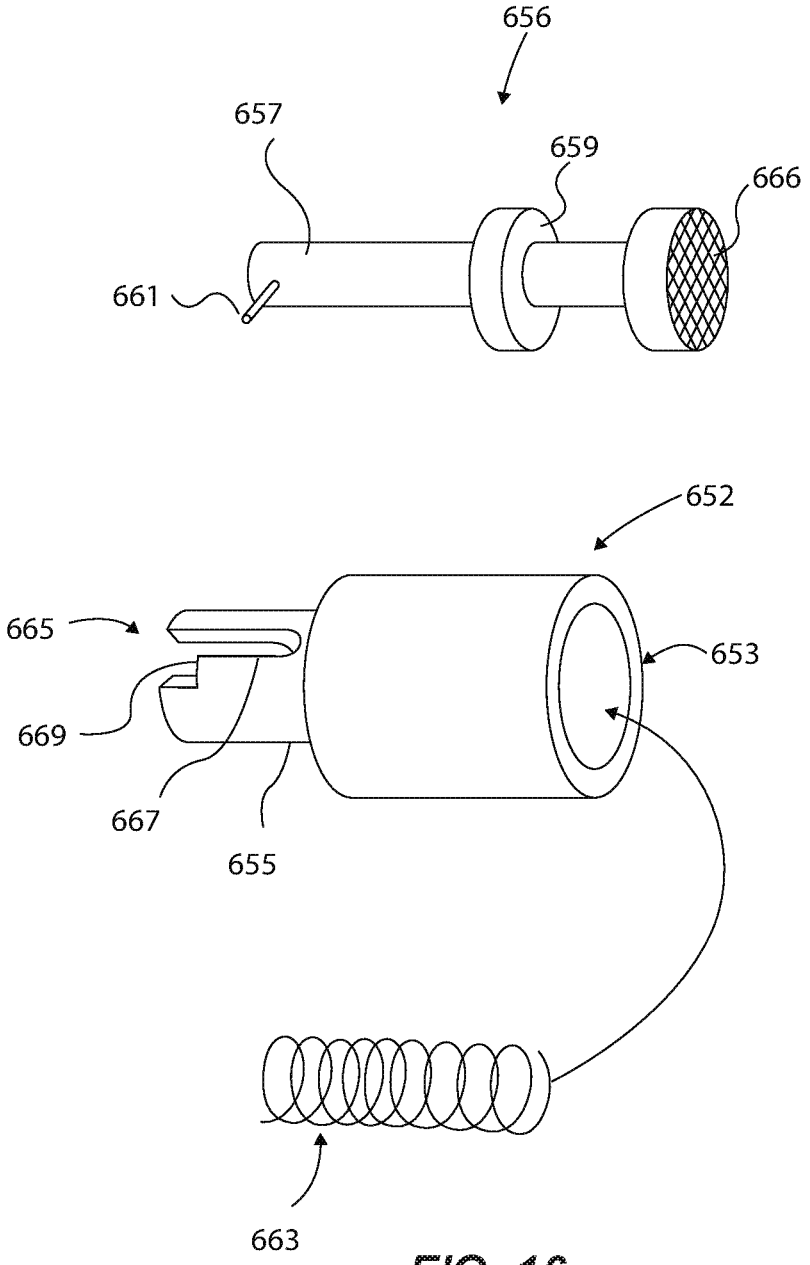
FIG. 16 illustrates various parts of a stud device according to embodiments of the present disclosure.
Figure 17:
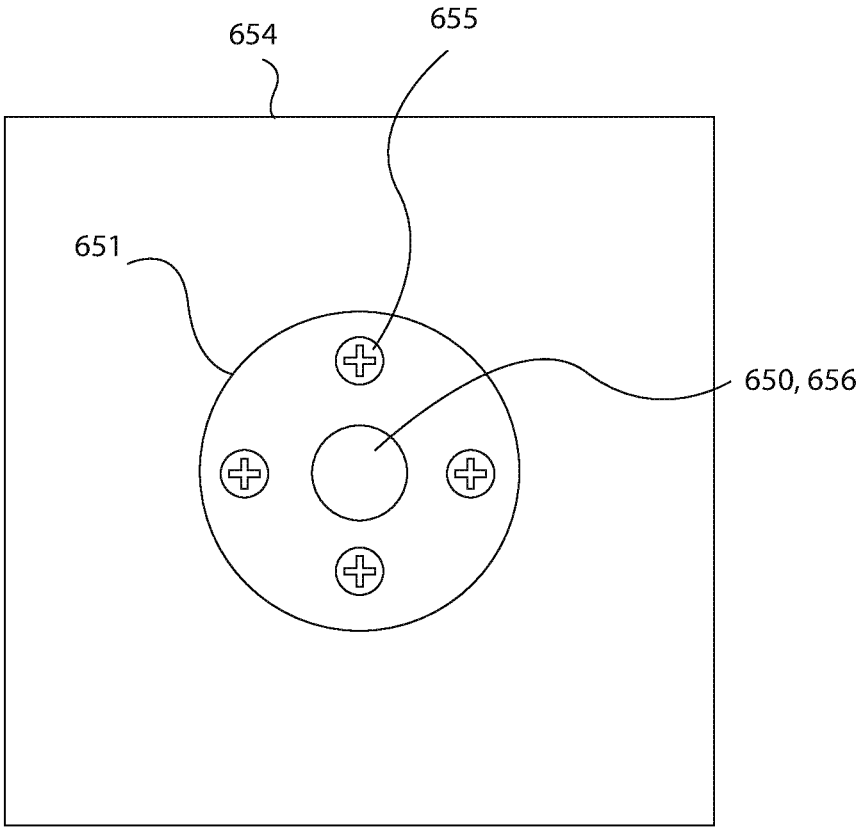
FIG. 17 illustrates a cover plate that can support the stud device of FIG. 16 according to embodiments of the present disclosure.

In one example illustrated in FIGS. 16 and 17, a stud device 650 comprises a mount 652 attached to a wall (similar to FIG. 12). A knob 656 extends from the mount 652 and extends outwardly from the wall (when deployed, as further described below). As such, the knob 656 is configured to receive an opening (e.g., 122 of FIG. 1) of a wall cover (e.g., 110 of FIG. 1). FIG. 17 shows a plate 651 attachable to the wall 654 and having an opening 653 to receive and support the stud device 650 such that the knob 656 (i.e., its head) is substantially flush with the plate when in a stowed position to form a substantially uniform surface about the plate 651, as further discussed below. The plate 651 can be fastened to the wall 654 by a plurality of fasteners 655 (e.g., 4 flush-mount fasteners countersunk into the plate). The plate 651 can be recessed into an opening of the wall 654, or it can slightly project outwardly from the wall 654.

Turning back to FIG. 16, the knob 656 can be selectively movable relative to the mount 652 from a stowed position to a deployed position. When in the stowed position (FIG. 17)

a head 666 of the knob 656 is flush with a planar surface of the plate 651. When in the deployed position, the head 666 protrudes from the plate 651 (or a wall) to receive an opening of a wall cover (somewhat like the head of FIG. 7). More specifically, the mount 652 can comprise a first tube 653 and a smaller (inner diameter) second tube 655 extending from an end of the first tube 653. The knob 656 includes the head 666, a shaft 657, and a protrusion 659 formed on the shaft 657. A locking device 661 (e.g. a roll pin) can be secured through a hole on an end of the shaft 657 and can protrude outwardly from the shaft 657 laterally.

A biasing device 663 (e.g., a coil spring) is operable to move and maintain the head 666 of the knob 656 in the deployed position. More specifically, the biasing device 663 can be concentrically disposed between the first tube 653 and the shaft 657 of the knob 656. On one end of the biasing device 663, it can be seated against a portion of the second tube 655 (i.e., an edge where the second tube meets the first tube). On the other end, the biasing device 663 is seated against a left surface of the protrusion 659 of the shaft 657 such that the knob 656 is axially movable about the mount 652 and biased outwardly by the coil spring, for instance, when in the deployed position.

Regarding the steps of locking (e.g., stowed) and unlocking (e.g., deployed) the knob 656 to the mount 652, the second tube 655 can comprise a locking portion 665 having an elongated recess 667 and a locking surface 669. In the stowed position (locked), the knob 656 is positioned through the mount 652 such that the planar surface of the head 666 is flush with a right end of the first tube 653 and such that the biasing device 663 would be compressed within the mount 652. In this manner, the knob 656 is positioned such that the locking device 661 is interfaced to (and retained by) the locking surface 669 of the locking portion 665 of second tube 655. To unlock/release the knob 656 from the stowed position to the deployed position (e.g., in order to hang a wall cover from it), an individual rotates the head 666 clockwise (e.g., using a thumb on a knurled surface of the head 666), which rotates the locking device 661 away from the locking surface 669. This positions the locking device 661 into the elongated recess 667 so that the locking device 661 traverses through the recess toward the first tube 653, thereby unlocking the shaft 657 from the mount 652, which thereby allows the biasing device 663 to release its potential energy and outwardly push the knob 656 from the first tube 653 to ready the knob 656 for use. Inversely, when the knob 656 is not needed and when it is undesirable to have protrusions extending from a wall, an individual can inwardly push the knob 656 into the mount 652 and then rotate it counter-clockwise until the locking device 661 re-engages the locking surface 669 to place the knob 656 into the stowed position. This stowed configuration provides a flush, planar surface that minimizes or avoids damage to objects or people when the knob 656 is not needed for use with a wall cover.

Figure 18:
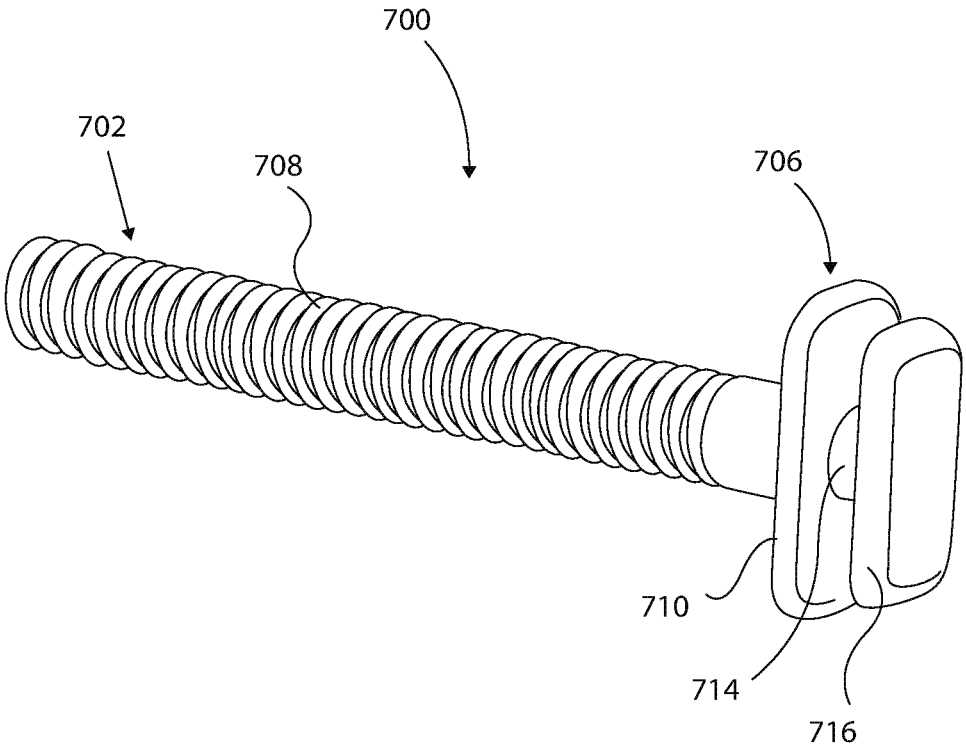
FIG. 18 is an isometric view of a stud device according to embodiments of the present disclosure.
Figure 19:
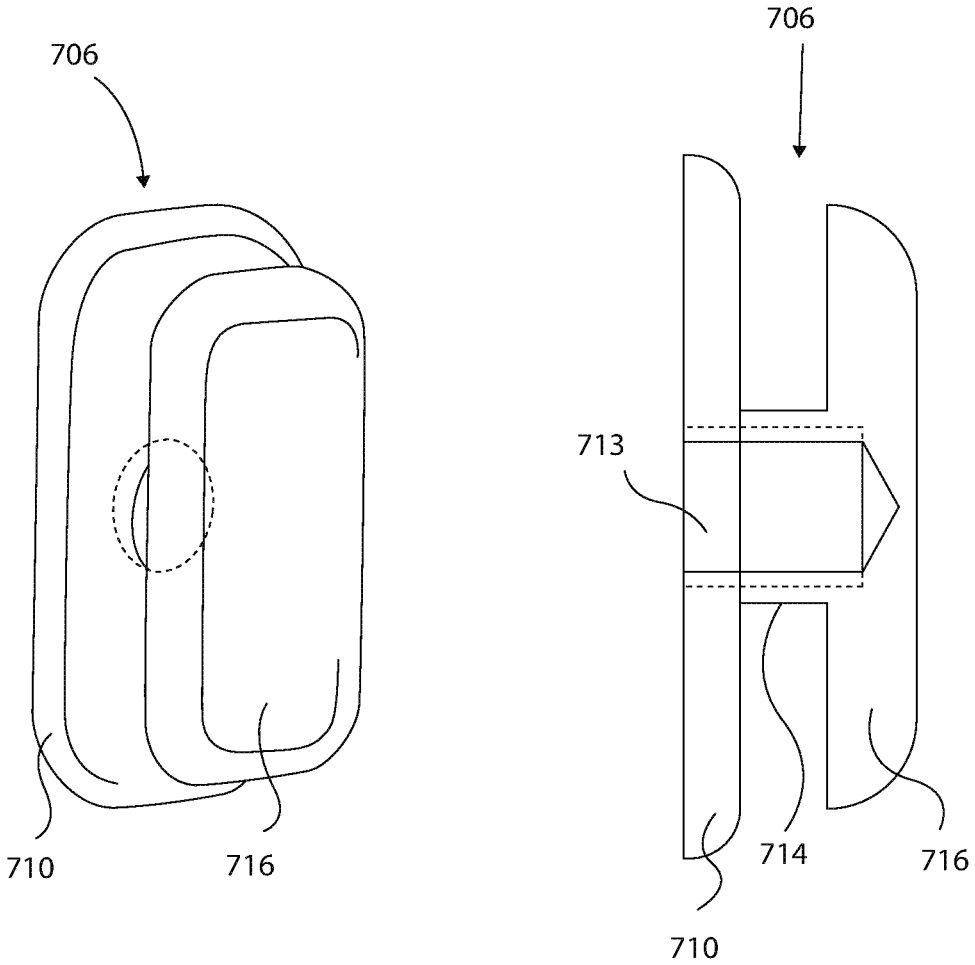
FIG. 19 is an isometric view and a side cross-sectional view of the knob of the stud device of FIG. 18 according to embodiments of the present disclosure.
Figure 20:
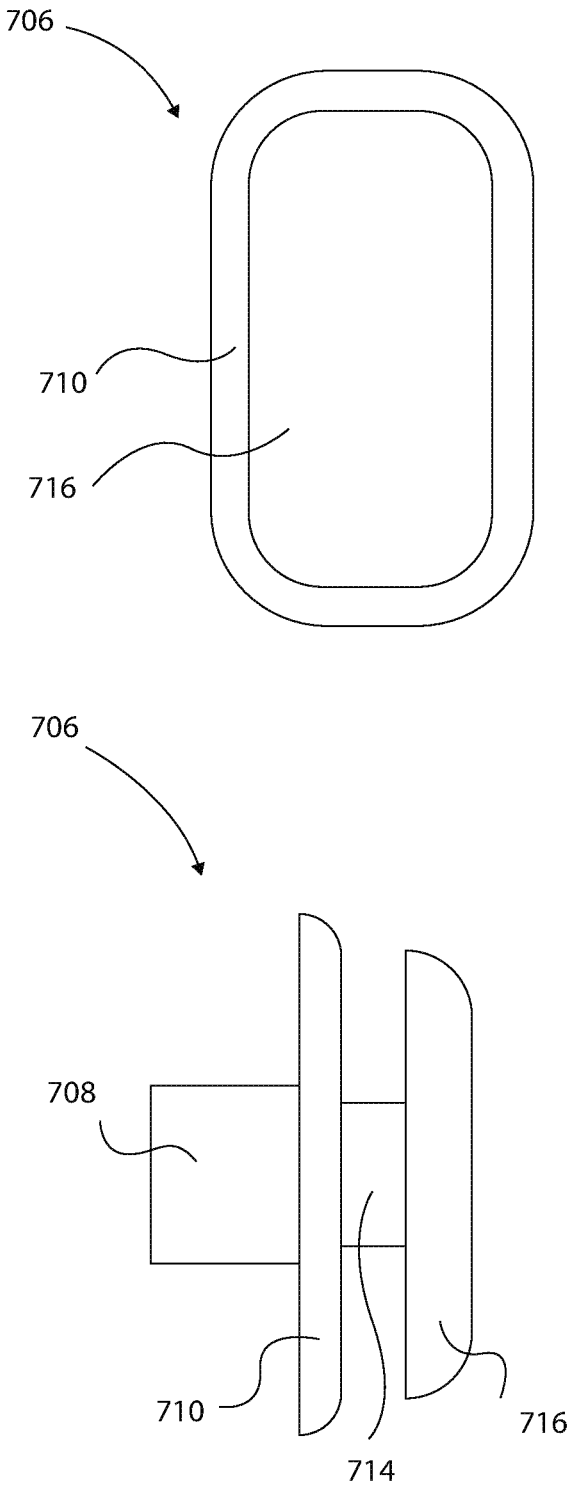
FIG. 20 is a front view and a side view of the stud device of FIG. 18 according to embodiments of the present disclosure.

In one example shown in FIGS. 18-20, a stud device 700 comprises a mount 702 attached to a wall (e.g., such as shown on FIG. 7). A knob 706 extends from the mount 702 and extends outwardly from the wall when attached. As such, the knob 706 is configured to receive an opening (e.g., 122 of FIG. 1) of a wall cover (e.g., 110 of FIG. 1). More specifically, the mount 702 includes a shaft 708 attached to (and through) a hole in the wall. A mount plate 710 extends outwardly from the shaft 708 and, in one example, is configured to be flush against a surface of the wall about an inside planar surface of the mount plate 710 (e.g., similar to FIG. 7). A stem 714 extends from the mount plate 710 and outwardly from the wall. A head 716 extends outwardly from the stem 714. Thus, the head 716 is configured (e.g., sized and shaped) to receive an opening of a wall cover to hang the wall cover from the stud device 700 to protect the wall. In this example, the head 716 and the mount plate 710 are vertically elongated rectangular shaped members that have corresponding shapes and sizes (although the mount plate 710 is slightly larger).

In one aspect, the shaft 708 is a threaded fastener that can be threadably secured to the wall by rotating the threaded fastener into the wall. In another aspect, the shaft 708 can receive a threaded nut on the other side of the wall, and the nut can be fastened to "pinch" the stud device 700 to the wall. This can help to reduce damage to the wall from threads tearing up the wall.

The stud device 700 can be a two-piece stud (like that in FIG. 15). Thus, the threaded shaft 708 includes a first threaded portion (threaded shaft portion) attachable through a hold in a wall, and a second threaded portion (not shown) at an end of the shaft 708 attached to the knob 706 (see the cross-sectional view of knob 706 in FIG. 19). As such, the knob 706 has a bore 713 (e.g., threaded) for receiving the second portion of the threaded shaft 708 so that the knob 706 can be removably attached to the mount 702 as desired. Thus, the mount 702 (i.e., threaded shaft 708) can remain in the wall for a certain time, or even indefinitely, while the knob 706 is removably attached when desired. In another example, the mount plate 710 is formed as part of the mount 702, and the stem 714 and the head 716 are rotatably fastened to an end of the threaded shaft 708 that would extend outwardly from the mount plate 710.

In a preferred example, a perimeter edge (e.g., an entire perimeter) of the head 716 is formed at an arc or radius between inner and outer planar surfaces of the head 716. Similarly, a perimeter edge of the mount plate 710 can be formed at a similar arc or radius as that of the radial edges of the head 716. Edge portions adjacent said perimeter edges (of 416 and 410) can also be chamfered (e.g., rounded, smoothed, angled, etc.) to minimize damage to objects impacting the stud device 400.

As can be appreciated from FIG. 20, a distance between the mount plate 710 and the head 716 is minimized, meaning that the stem 714 is just wide enough to vertically support a relatively thin panel(s) of fabric (e.g., trim of a wall cover). This "short" stem, along with the radial edges of the head 716 and the mount plate 710, collectively provide a low-profile protrusion (stud device) extending from the wall and that has minimal "sharp" edges or surfaces. This can minimize damage to the stud mount and to the impacting objects (or people) because the impacting object will tend to "slide along" the smoothed/angled surfaces of the stud device, which reduces the chance of something getting snagged or damaged when contacting the stud device accidentally. In one example, a height of the head 716 is approximately ⅝" and a width is approximately 5/16" (approximately a 2:1 ratio to each other), as shown on the upper drawing of FIG. 20. In the lower drawing, a lateral length of the stem 714 (between 710 and 716) is approximately 0.10" (just wide enough to receive and support a thin fabric panel, or two thin fabric panels, each being less than 0.05" each, for instance). A thickness of the knob 706 (i.e., a length the knob extends from the wall) can be 0.26", or even less in some examples. This example provides a low-profile stud device that can only protrude from the wall about ¼ of an inch, which still providing structural support for a wall cover hanging therefrom.

Regarding the stud devices (and knobs) of the examples described in FIGS. 1-20, an advantage over existing knobs is that the knob of the present disclosure can have an overall distance extending outwardly from the wall at a distance less than ⅜ of an inch. In preferred examples, the knob can have an overall distance extending outwardly from the wall at a distance approximately ¼ of an inch. Existing knobs have an overall distance from the wall greater than ⅜ of an inch (in order to receive a grommet). In the present disclosure, the stud devices and knobs are low-profile (e.g., less than ⅜ inch from the wall) because they are designed to support very thin fabric wall cover trim(s) (as opposed to existing knobs that must receive thicker, plastic grommets secured to existing wall covers). This lower-profile knob of the present disclosure is highly desirable by contractors and building owners, for example, because projections extending from walls are not aesthetic and are safety hazards. Thus, minimizing the distance of the projections from walls is important and desirable.

While the preferred embodiments of the invention have been illustrated and described, as noted above, many changes can be made without departing from the spirit and scope of the invention. Accordingly, the scope of the invention is not limited by the disclosure of the preferred embodiments. Instead, the invention should be determined entirely by reference to the claims that follow.

The invention claimed is:

1. An elevator wall cover assembly for hanging from a projection extending from an elevator wall, the assembly comprising:

a cover that includes a substantially flat, protective, and flexible sheet of material having sufficient thickness and rigidity to protect a surface of the wall;

a trim formed from a strip of material that is separate from the sheet of material of the cover and attached to an upper portion of the cover to extend substantially horizontally along the upper portion of the cover, the trim having an upper portion and a lower portion, wherein the lower portion of the trim is attached to the cover such that at least a portion of the cover extends below the lower portion of the trim; and a plurality of openings formed along the trim and configured to receive the projection from the wall in any of several of the plurality of openings to hang the cover from the wall.

2. The wall cover assembly of claim 1, wherein one or more of the plurality of openings are at least one of a slit, a hole, a key-hole opening including a slit portion and a hole portion, or a crescent shape opening.

3. The wall cover assembly of claim 1, wherein the trim is formed from a flexible strip of material such that deforming the trim at the openings causes the openings to more widely open.

4. The wall cover assembly of claim 1, wherein the openings are formed by cutting through the trim.

5. The wall cover assembly of claim 1, wherein the openings are formed by hot-cut melting through a portion of the trim.

6. The wall cover assembly of claim 1, wherein the trim is attached to the upper portion of the cover by one or more stitches.

7. The wall cover assembly of claim 1, wherein the openings are aligned with the upper portion of the cover.

8. The wall cover assembly of claim 1, wherein the cover comprises an upper edge that extends above the upper portion of the cover and above the upper portion of the trim.

9. The wall cover assembly of claim 1, wherein the trim is formed at least in part from a woven synthetic strip of material.

10. The wall cover assembly of claim 1, wherein at least one of the plurality of openings is configured to receive a projection having a base and a stem protruding from the base, wherein the base provides a stable support for the stem and is securable to the wall with a quick-curing permanent adhesive.

11. The wall cover assembly of claim 10, wherein the projection further includes a head coupled to the stem, wherein the head is slightly larger than the stem to maintain the elevator cover assembly on the projection.

12. The wall cover assembly of claim 1, the trim further includes a fold between the upper portion of the trim and the lower portion of the trim, wherein the fold is formed by folding the trim over the upper portion of the cover with the upper and lower portions of the trim contacting a first side and a second side of the cover with the first edge upper portion and the second edge lower portion of the trim being substantially aligned and stitched together through the upper portion of the cover, and wherein each of the plurality of openings is positioned on the trim and between the upper portion of the trim and the fold.

13. The wall cover assembly of claim 1, wherein the upper portion of the cover has an irregular profile, including at least one of a flat, stepped, curved, or angled portion, the assembly further comprising separate trim portions corresponding to the at least one of a flat, stepped, curved, or angled portion.

14. The wall cover assembly of claim 1, wherein the projection comprises a stud device attachable to the wall, the stud device having a mount attachable to the wall and a knob extending from the mount, wherein the knob is configured to receive the opening to hang the cover.

15. The wall cover assembly of claim 14, wherein the knob further includes a mount plate, a stem, and head extending from the stem, wherein the mount plate is interfaceable to the wall and wherein the stem and the head extend from the mount plate, and wherein the head is larger than the stem to retain the opening about the stud device.

16. The wall cover assembly of claim 15, wherein the mount is a threaded shaft attachable to the wall and extends from the mount plate.

17. The wall cover assembly of claim 15, wherein the head has a cross sectional area having a shape being one of a square, a rectangle, an oval, a circle, and a polygon.

18. The wall cover assembly of claim 17, wherein the cross sectional area of the head is smaller than a cross sectional area of the mount plate.

19. The wall cover assembly of claim 15, wherein the stud device further comprises a threaded fastener disposed through a hole in the head, the stem, and the mount plate, wherein the threaded fastener is attachable to the wall.

20. The wall cover assembly of claim 14, wherein the mount is a threaded shaft attachable to the wall and the knob has a conically shaped body extending outwardly from the mount and the wall.

21. The wall cover assembly of claim 20, wherein the conically shaped body has a side wall defining a cavity that permits passage of a tool into the cavity to rotatably and removably attach the stud device to the wall.

22. The wall cover assembly of claim 14, wherein the mount is a threaded shaft having a first threaded portion attachable to the wall and a second threaded portion attached to the knob such that the knob is removable from the mount while the mount remains attached to the wall.

23. The wall cover assembly of claim 22, wherein the knob has a threaded bore for receiving the second threaded portion of the mount, and wherein the knob has a conically shaped body extending outwardly from the mount and the wall.

24. The wall cover assembly of claim 14, wherein the knob is selectively movable relative to the mount from a stowed position to a deployed position, wherein the knob receives the opening of the cover when in the deployed position, and wherein the knob is moved toward the mount when moved from the deployed position to the stowed position.

25. The wall cover assembly of claim 24, further comprising a biasing device operable to move and maintain the knob in the deployed position.

26. The wall cover assembly of claim 25, wherein the biasing device is a coil spring concentrically disposed between a cylindrical housing of the mount and a shaft of the knob, wherein the coil spring is seated against a portion of the mount and against a protrusion on the shaft of the knob such that the knob is movable about the cylindrical housing.

27. The wall cover assembly of claim 26, wherein the shaft of the knob comprises a locking device interfaceable to a locking surface of the mount such that rotational movement of the knob selectively locks the knob in the stowed position, when the knob is depressed, and such that opposite rotational movement of the knob unlocks the knob, thereby releasing energy from the coil spring, to move the knob to the deployed position.

28. The wall cover assembly of claim 24, further comprising a plate attachable to the wall and having an opening to receive and support the stud device such that the knob is substantially flush with the plate when in the stowed position to form a substantially uniform surface about the plate.

29. The wall cover assembly of claim 14, wherein the knob has an overall distance extending outwardly from the wall at a distance less than ⅜ of an inch.

30. The wall cover assembly of claim 14, wherein the knob has an overall distance extending outwardly from the wall at a distance approximately ¼ of an inch.

31. A method of forming a wall cover assembly for hanging from a projection extending from an elevator wall, comprising:

forming a wall cover from a substantially flat, protective, and flexible sheet of material having sufficient thickness and rigidity to protect a surface of the wall;

forming a trim from a strip of material that is separate from the sheet of material of the cover, the trim having an upper portion and a lower portion;

forming a plurality of openings along the trim and configured to receive the projection from the wall in any of several of the plurality of openings to hang the cover from the wall; and attaching the trim to an upper portion of the cover to extend substantially horizontally along the upper portion of the cover, wherein the lower portion of the trim is attached to the cover such that at least a portion of the cover extends below the lower portion of the trim.

32. The method of claim 31, further comprising positioning the wall cover assembly with the openings over one or more knobs on the wall to hang the wall cover assembly from the wall, the openings being mated to the knobs based on which openings are closest to the knobs.

33. The method of claim 31, wherein forming the plurality of openings comprises cutting into the trim.

34. The method of claim 31, wherein forming the plurality of openings comprises melting through a portion of the trim.

35. The method of claim 34, further comprising melting a portion of the trim around a perimeter of the openings to prevent fraying.

36. The method of claim 31, further comprising deforming the trim to cause the openings to open, and positioning a knob within one of the openings.

37. The method of claim 31, further comprising positioning the trim relative to the cover such that a portion of the trim extends beyond the upper portion of the wall cover when the wall cover is hung.

38. The method of claim 31, further comprising folding the trim over the upper portion of the wall cover.

39. The method of claim 31, wherein forming openings in the trim comprises forming openings that pass through the trim and at least a portion of the wall cover.

40. The method of claim 31, wherein the cover has an irregular profile, including one or more cover regions having a stepped or angled profile, the method further comprising attaching the trim in segments to the cover regions at lengths corresponding to the length of the cover regions.

* * * * *